US010531199B2

(12) United States Patent
Escobar et al.

(10) Patent No.: US 10,531,199 B2
(45) Date of Patent: Jan. 7, 2020

(54) VEHICLE SOUND SYSTEM

(71) Applicant: Honda Motor Co., Ltd., Tokyo (JP)

(72) Inventors: Edgar Arturo Escobar, Hilliard, OH (US); Christopher L. Steinmeyer, Hilliard, OH (US); David T. Christian, Jr., Troy, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/921,046

(22) Filed: Mar. 14, 2018

(65) Prior Publication Data

US 2019/0289398 A1 Sep. 19, 2019

(51) Int. Cl.

| | |
|---|---|
| ***H04R 7/04*** | (2006.01) |
| ***H04R 1/02*** | (2006.01) |
| ***H04R 1/26*** | (2006.01) |

(52) U.S. Cl.

CPC ..... *H04R 7/045* (2013.01); *H04R 1/025* (2013.01); *H04R 1/26* (2013.01); *H04R 2201/028* (2013.01); *H04R 2499/13* (2013.01)

(58) Field of Classification Search

None

See application file for complete search history.

(56) References Cited

U.S. PATENT DOCUMENTS

| | | | | |
|---|---|---|---|---|
| 4,326,099 | A | 4/1982 | Maille | |
| 4,704,729 | A | 11/1987 | Franzini et al. | |
| 5,865,277 | A | 2/1999 | Hunter | |
| 5,875,250 | A | 2/1999 | Kuo et al. | |
| 5,901,231 | A * | 5/1999 | Parrella | H04R 17/00 381/152 |
| 6,332,029 | B1 * | 12/2001 | Azima | B42D 15/022 181/166 |
| 6,865,277 | B2 * | 3/2005 | Bank | H04R 1/028 381/152 |
| 7,194,098 | B2 | 3/2007 | Azima et al. | |
| 7,661,749 | B2 | 2/2010 | Balcerzak et al. | |
| 8,044,413 | B2 | 10/2011 | Albus et al. | |
| 9,154,862 | B2 * | 10/2015 | Cheung | H04R 1/02 |
| 9,723,409 | B2 * | 8/2017 | Smearcheck | H04R 7/045 |
| 2004/0109575 | A1 * | 6/2004 | Thigpen | H04R 5/02 381/302 |
| 2004/0258256 | A1 | 12/2004 | Ruff | |
| 2005/0013453 | A1 * | 1/2005 | Cheung | H04R 7/045 381/152 |
| 2005/0084131 | A1 | 4/2005 | Fordham et al. | |
| 2008/0089537 | A1 * | 4/2008 | Scheel | H04R 7/045 381/152 |
| 2010/0272294 | A1 | 10/2010 | Arknaes-Pedersen et al. | |

(Continued)

FOREIGN PATENT DOCUMENTS

WO 2017031422 A1 2/2017

*Primary Examiner* — Paul W Huber

(74) *Attorney, Agent, or Firm* — Armstrong Teasdale LLP

(57) ABSTRACT

A vehicle sound system and method of generating sound having a plurality of frequency responses are provided. The vehicle sound system includes selecting each of a plurality of acoustic panel assemblies based on a frequency range of sound pressure vibrations the acoustic panel assembly is capable of generating, and positioning the plurality of acoustic panel assemblies within a vehicle at a respective locations within the vehicle based on the frequency range of sound pressure vibrations the acoustic panel assembly is capable of generating.

15 Claims, 10 Drawing Sheets

(56) References Cited

U.S. PATENT DOCUMENTS

| | | | | |
|---|---|---|---|---|
| 2011/0056763 | A1* | 3/2011 | Tanase | B60R 13/0815<br>181/295 |
| 2012/0140945 | A1* | 6/2012 | Harris | H04R 1/403<br>381/86 |
| 2016/0165329 | A1 | 6/2016 | Fedyay et al. | |

* cited by examiner

VEHICLE SOUND SYSTEM

BACKGROUND

This description relates to vehicle audio entertainment and communication systems, and, more particularly, to off-road vehicle sound systems.

At least some known vehicles include audio systems for entertainment, programming, communications, or other audio output. Known audio systems typically include at least one audio source, an amplifier, an equalizer, and speakers mounted in the interior compartment of the vehicle. Some vehicles, such as, off-road vehicles, for example, side-by-side (S×S) style vehicles, may have very limited room for speaker placement within the interior compartment of the vehicle due to S×S vehicles being typically much smaller than automobiles. Consequently, typical areas where speakers are placed (i.e., door panels and dashboards) are often not able to accommodate the size of speakers used. Speakers placed outside the passenger compartment are subject to a harsh environment, which may shorten the life of the speakers and/or affect the sound quality of the speakers. Alternatives include using smaller speakers or sacrificing high fidelity of the sound provided by the vehicle audio system.

BRIEF DESCRIPTION

In one embodiment, a vehicle sound system includes a plurality of acoustic panel assemblies positionable within a vehicle. Each acoustic panel assembly includes a first sound panel formed of a material having predetermined physical dimensions and a first flexural modulus and one or more acoustic exciters coupled to each of the first sound panels. Each acoustic exciter is configured to receive a first audio signal that includes a first frequency range. Each of the first sound panels are configured to generate a sound signal including a respective range of sound pressure vibrations dependent on the first flexural modulus, the predetermined physical dimensions of the first sound panel, and the first audio signal received by the one or more acoustic exciters. A first acoustic panel assembly of the plurality of acoustic panel assemblies is formed to generate a first sound signal in a first range of sound pressure vibrations from the first audio signal and positioned in a first location in the vehicle. A second acoustic panel assembly of the plurality of acoustic panel assemblies formed to generate a second sound signal in a second range of sound pressure vibrations from the first audio signal and positioned in a second location in the vehicle, the second range of sound pressure vibrations being different then the first range of sound pressure vibrations.

In another embodiment, a method of generating sound having a plurality of frequency responses includes selecting each of a plurality of acoustic panel assemblies based on a frequency range of sound pressure vibrations the acoustic panel assembly is capable of generating and positioning the plurality of acoustic panel assemblies within a vehicle at a respective locations within the vehicle based on the frequency range of sound pressure vibrations the acoustic panel assembly is capable of generating.

In yet another embodiment, a speakerless vehicle sound system includes a plurality of acoustic panel assemblies positioned within a vehicle according to a frequency response of each of the plurality of acoustic panel assemblies to a single electrical audio signal. Each of the plurality of acoustic panel assemblies includes an acoustic exciter configured to receive the single electrical audio signal and coupled to a sound panel that forms a part of a structural or aesthetic component of the vehicle. The sound panel is configured to generate a range of sound pressure vibrations dependent on a flexural modulus of a material that the sound panel is formed of, a set of dimensions of the sound panel, and the single electrical audio signal.

BRIEF DESCRIPTION OF THE DRAWINGS

FIG. 1 is schematic illustration of a vehicle audio system showing various speakers operably coupled to an amplifier and various exterior audio assemblies or acoustic exciters operably coupled to the amplifier.

FIG. 2 is a graph of an example frequency response of the vehicle audio system shown in FIG. 1.

FIG. 3 is a side elevation view of an acoustic panel assembly that may be used with the vehicle sound system shown in FIG. 1.

FIG. 4 is a side elevation view of an acoustic panel assembly that may be used with the vehicle sound system shown in FIG. 1 in accordance with another example embodiment of the present disclosure.

FIG. 5 is a side perspective view of acoustic panel assembly during operation of acoustic exciter.

FIG. 6 is a perspective view of a vehicle, such as, but not limited to a side-by-side (SxS) off-road vehicle.

FIG. 7 is a perspective view of vehicle shown in FIG. 6 in accordance with another example embodiment of the present disclosure.

FIG. 8 is a perspective view of vehicle shown in FIG. 7 in accordance with another example embodiment of the present disclosure.

FIG. 9 is a perspective view of vehicle in accordance with another example embodiment of the present disclosure.

FIG. 10 is a flowchart of an example method of generating sound having a plurality of frequency responses.

Figure 1:
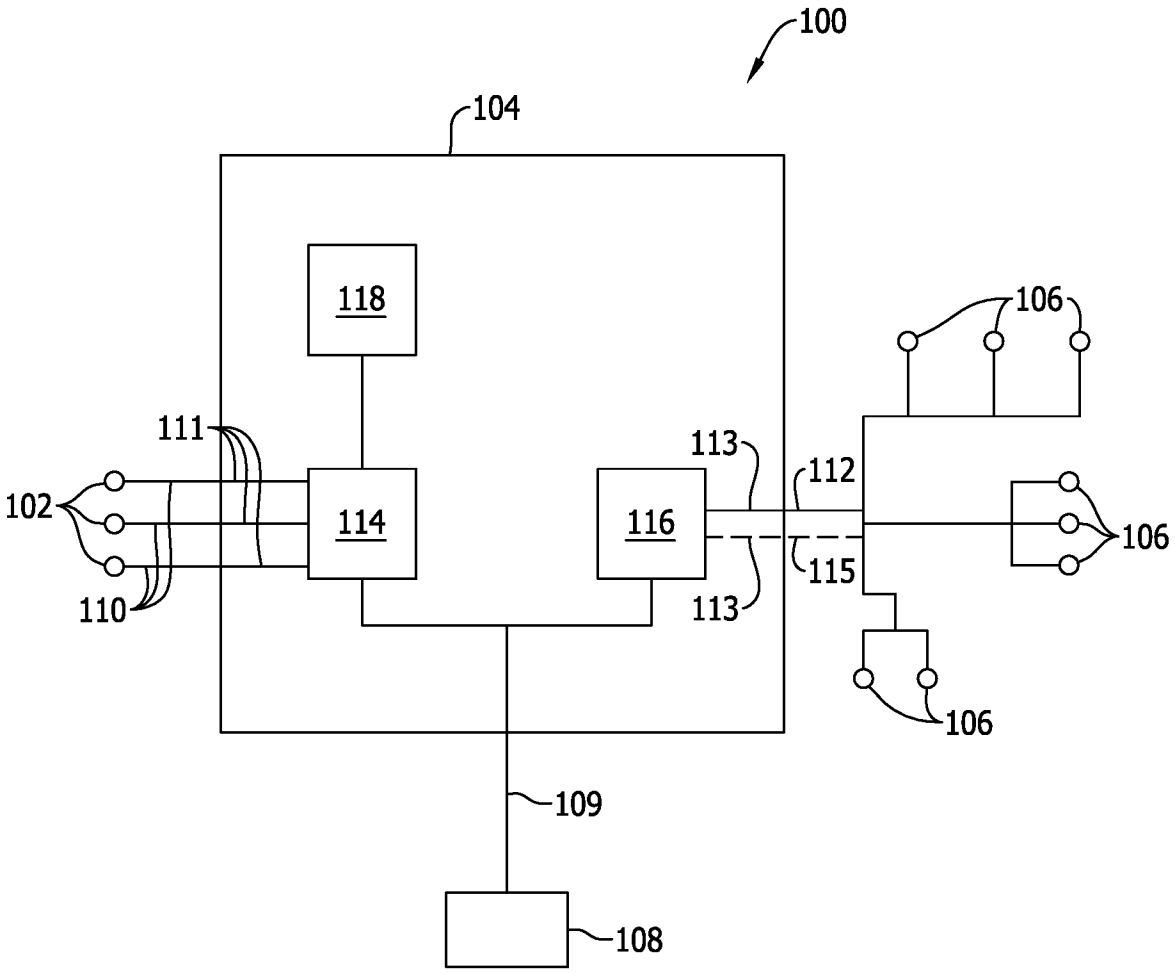
FIGS. 1-10 show example embodiments of the method and systems described herein.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

Various embodiments of the present disclosure are better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., systems, devices, processors, controllers, or memories) may be implemented in a single piece of hardware (e.g., a general purpose signal processor or random access memory, hard disk, or the like) or multiple pieces of hardware. Similarly, any programs may be stand-alone programs, may be incorporated as subroutines in an operating system, may be functions in an installed software package, and the like. It should be understood that the various embodiments are not limited to the arrangements and instrumentality shown in the drawings.

As used herein, the terms "module", "system," or "unit," may include a hardware and/or software system that operates to perform one or more functions. For example, a module, unit, or system may include a computer processor, controller, or other logic-based device that performs operations based on instructions stored on a tangible and non-transitory computer readable storage medium, such as a computer memory. Alternatively, a module, unit, or system may include a hard-wired device that performs operations based on hard-wired logic of the device. The modules, units, or systems shown in the attached figures may represent the hardware that operates based on software or hardwired instructions, the software that directs hardware to perform the operations, or a combination thereof.

As used herein, an element or step recited in the singular and proceeded with the word "a" or "an" should be understood as not excluding plural of the elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments of methods and systems for forming, installing and operating a vehicle sound system are provided. It should be noted that although the various embodiments are described in connection with the automotive industry, such as, but not limited to, a truck, a utility vehicle, and a side-by-side vehicle (SxS) one or more embodiments may be implemented in different types of vehicles, in different industries and for different applications. Additionally, while embodiments described herein refer to a vehicle audio system that provides audio output external to the vehicle, such as in a cargo bed of the vehicle, the audio output may be provided at other areas of the vehicle in other various embodiments.

One or more embodiments include a system, which may be implemented as a programmable logic controller (PLC) that controls various functions and operations of the audio system of the vehicle, such as the audio input, the audio output, equalization of the audio output to speakers, such as to control frequency response of the speakers, such as to control bass, treble and the like, battery saving features, such as to turn off various electrical systems, and the like. The controller may control display functions on one or more display devices or screens.

In various embodiments, the system may include both interior acoustic panel assemblies and exterior acoustic panel assemblies. The exterior acoustic panel assemblies provide a full range of audio output external to the vehicle, such as for use when people are around the outside of the vehicle. For example, during tailgating, while doing chores, while washing the vehicle and the like, the vehicle audio system may be used and does not need to rely on speakers inside the vehicle passenger compartment to produce the sound. As such, the windows or doors do not need to be open to listen to the audio system.

As used herein, flexural modulus or bending modulus is an intensive property of a material that is computed as the ratio of stress to strain in flexural deformation, or the tendency for the material to bend. The flexural modulus is inversely related to deflection—a lower deflection results in a higher flexural modulus. In other words, a higher flexural modulus material is "stiffer" than a lower flexural modulus material.

The following description refers to the accompanying drawings, in which, in the absence of a contrary representation, the same numbers in different drawings represent similar elements.

FIG. 1 is schematic illustration of a vehicle audio system 100 having speakers 102 operably coupled to an amplifier 104 and various exterior audio assemblies or acoustic exciters 106 operably coupled to amplifier 104. Although vehicle audio system 100 is illustrated showing an interior audio system that includes speakers, vehicle audio system 100 may also be configured without the interior portion. An audio source device 108 provides a low power audio signal 109 to amplifier 104. In various embodiments, audio source device 108 may be embodied in an FM, AM, or satellite radio receiver, a compact disk (CD) or MP3 player, and the like. In the illustrated embodiment, amplifier 104 is configured to amplify low power audio signal 109 and to output higher power audio signals 110 over one or more channels 111. Each speaker 102 is communicatively coupled to a corresponding channel 111 of amplifier 104. Similarly, each acoustic exciter 106 is communicatively coupled to a single channel 112 of amplifier 104, which provides a single higher power audio signal 113. In other embodiments, a second channel 115 may be used to power a portion of acoustic exciters 106.

In the exemplary embodiment, amplifier 104 includes an interior audio module 114 with speakers 102 coupled to interior audio module 114 and an exterior audio module 116 with acoustic exciters 106 coupled to the exterior audio module 116. Various selectable audio modes may operate interior audio module 114 and exterior audio module 116 in conjunction with each other, or one or the other of interior audio module 114 and exterior audio module 116 may be operated individually.

An equalizer 118 is only used with interior audio module 114 and speakers 102. Equalizer 118 may operate speakers 102 at different frequencies. For example, each channel 111 of the one or more channels 111 may be operated at a different frequency. Equalizer 118 controls the output of the one or more channels 111 differently from each other of the one or more channels 111. Optionally, an output of amplifier 104 may be controlled by equalizer 118 to achieve a desired sound quality target including, but not limited to, factors such as distortion, clarity and frequency response for each of speakers 102. Equalizer 118 may control the output of the one or more channels 111 based on various factors, such as the characteristics of each speaker 102, a mounting location of each speaker 102 within a vehicle. For reasons that are explained below, equalizer 118 is not needed or used with exterior audio module 116 and acoustic exciters 106. Exterior audio module 116 provides an unequalized audio signal 113 to acoustic exciters 106.

Figure 2:
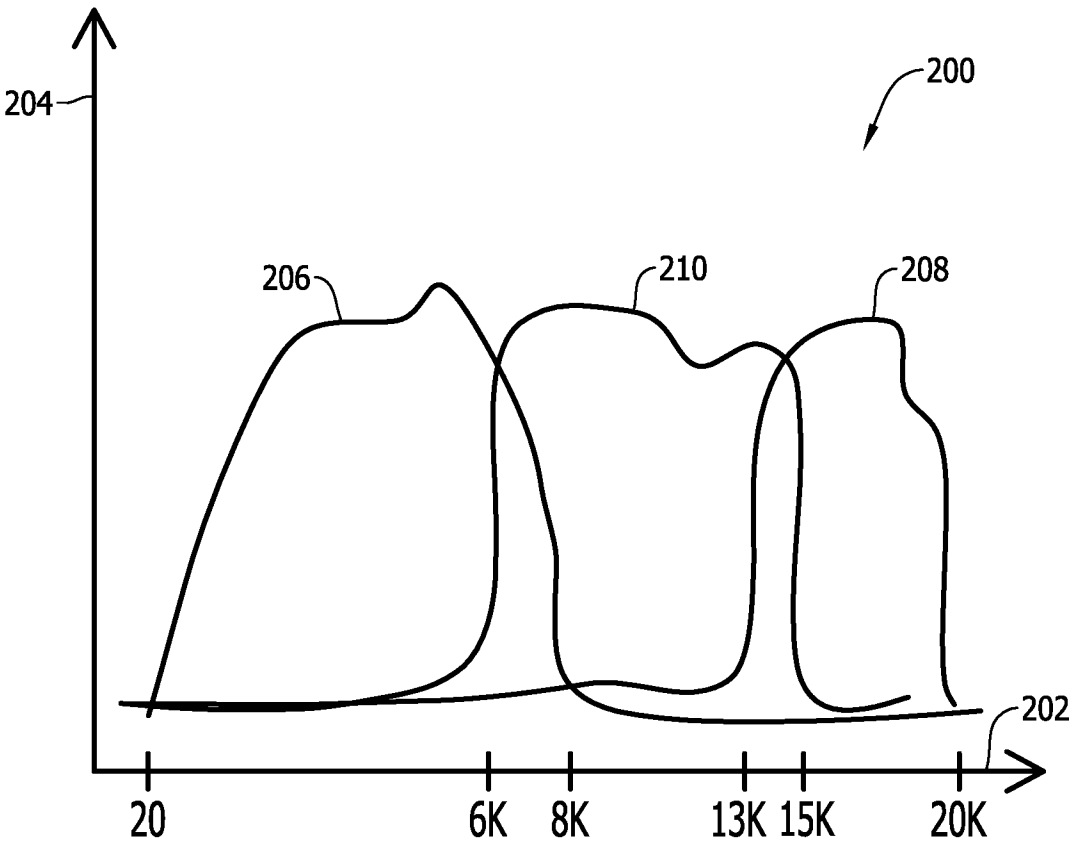

FIG. 2 is a graph 200 of an example frequency response of vehicle audio system 100 (shown in FIG. 1). In the example embodiment, graph 200 includes an x-axis 202 graduated in units of frequency, such as, but not limited to, Hertz (Hz) and a y-axis 204 graduated in units of sound pressure level (SPL) or acoustic pressure graduated in units of, for example, Pascal (Pa). A first trace 206 represents a relatively low frequency response, a second trace 208 represents a relatively high frequency response, and a third trace 210 represents a frequency response between low frequency response, first trace 206 and high frequency response, second trace 208. SPL represents a local pressure deviation from the ambient atmospheric pressure, caused by a sound wave.

First trace 206 represents a bass-frequency response between approximately 20 Hz and 8,000 Hz. Second trace 208 represents a treble-frequency response between approximately 13,000 Hz and approximately 20,000 Hz. Third trace 210 represents a mid-range-frequency response between approximately 6,000 Hz and 15,000 Hz. First trace 206, second trace 208, and third trace 210 together represent a full range of frequency responses, which a human typically can hear. Each of first trace 206, second trace 208, and third trace 210 are generated using a single audio signal channeled to identical acoustic exciters (shown in FIG. 3) coupled to one or more sound panels (also shown in FIG. 3) on a vehicle (shown in FIG. 6). A vibratory response of each of the one or more sound panels is predetermined based on a flexural modulus of a material the sound panels are formed of, physical dimensions of the sound panels, dimensional features of the sound panels, stiffening or other flexural treatment of the sound panels, or combinations thereof.

The flexural modulus of the sound panels may be defined by the material properties of the material the sound panels are formed of. For example, a length of a fiber used in the material, the cross-section of the fibers, and a filler material used in forming the sound panel may define a certain flexural modulus of the sound panel. Likewise a density of the material, and the mechanical joining of layers of the layer also facilitate defining the flexural modulus of the sound panel.

The flexural modulus of the sound panels may also be defined by physical dimensions of the sound panels. Such physical dimensions include a thickness of the sound panel, a gradient of the thickness across the sound panel, a length, a width, and an overall shape or outline of the sound panel can affect the structural modulus of the sound panel.

The flexural nodulus of the sound panels may further be defined by dimensional features of the sound panels, stiffening, or other flexural treatment of the sound panels, including heat treatment and fastening configurations.

Figure 3:
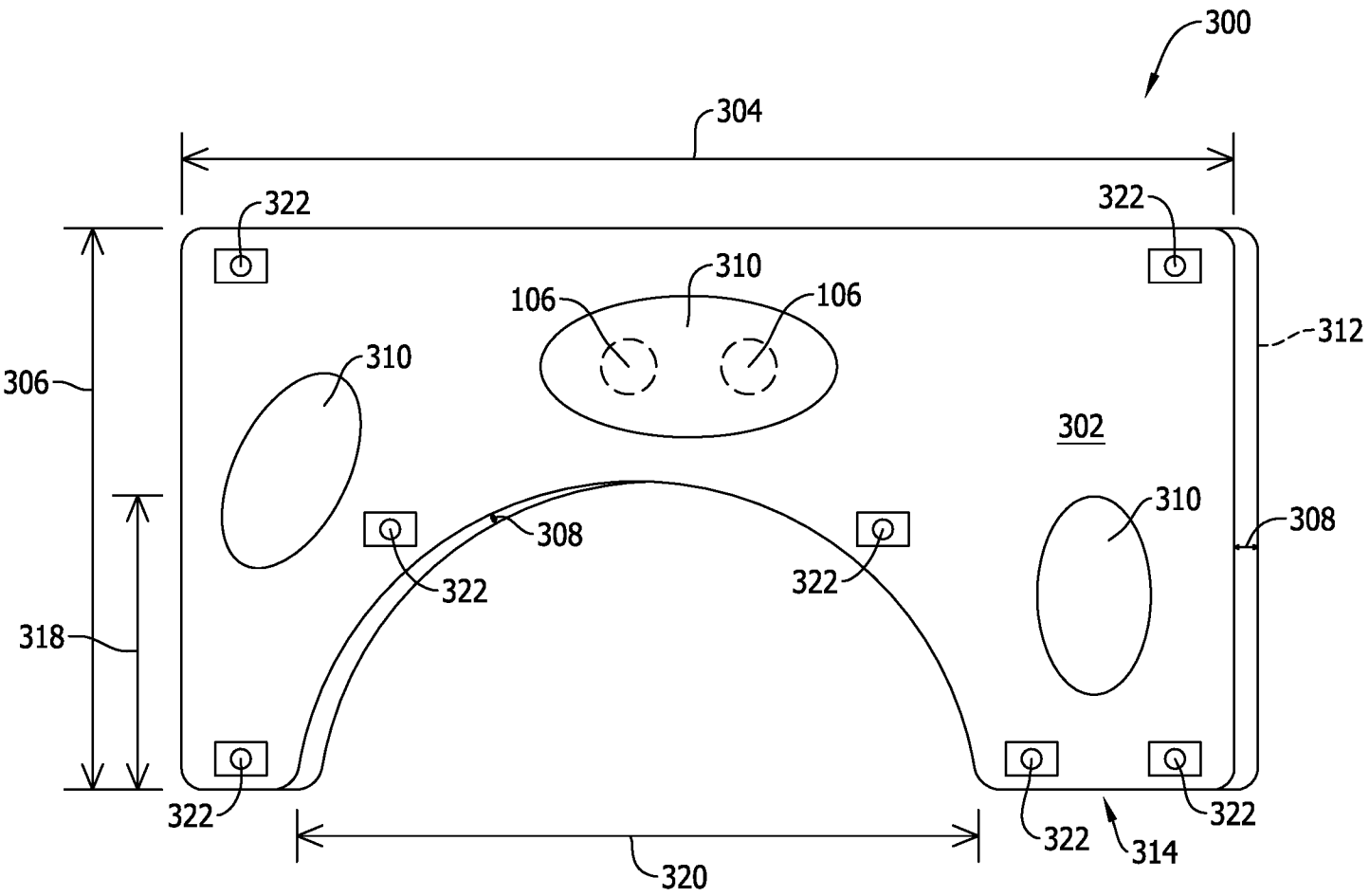
Figure 4:
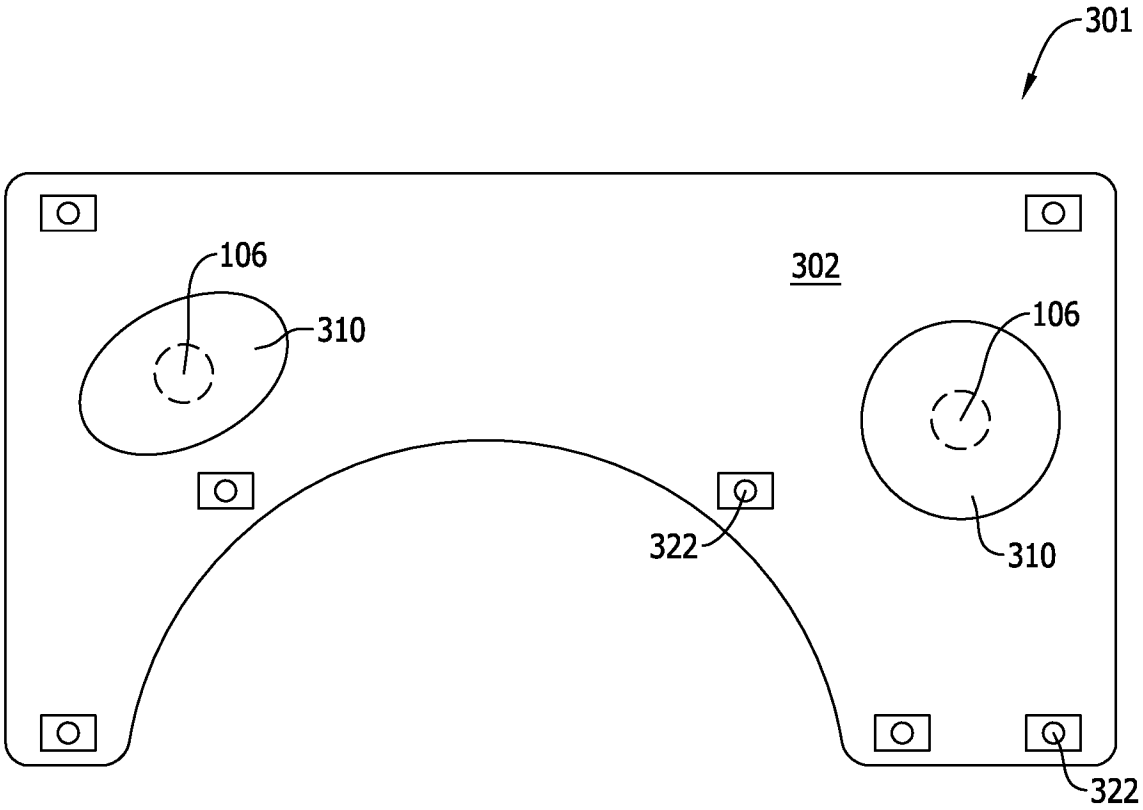

FIG. 3 is a side elevation view of an acoustic panel assembly 300 that may be used with vehicle audio system 100 (shown in FIG. 1). FIG. 4 is a side elevation view of an acoustic panel assembly 301 that may be used with vehicle audio system 100 (shown in FIG. 1) in accordance with another example embodiment of the present disclosure. For example, acoustic panel assembly 300 can define an interior portion of a cargo bed of a vehicle and/or may define an interior portion of, for example, a passenger compartment or cabin of a vehicle. In the example embodiment, acoustic panel assembly 300 includes a sound panel 302 formed of a material having a respective flexural modulus. In various embodiments, the flexural modulus is homogeneous across a width 304, height 306, and a thickness 308 of sound panel 302. In other embodiments, the flexural modulus is not homogeneous and may be varied throughout various areas 310 of sound panel 302 to tailor a vibratory response of sound panel 302 to acoustic exciters 106. In FIG. 3, acoustic exciters 106 are shown in dotted lines because they are mounted to an opposite side 312 of sound panel 302. Acoustic exciters 106 are coupled to sound panel 302 in areas predetermined to provide desired sound pressure vibrations. Each acoustic exciter 106 is configured to receive audio signal 113. Audio signal 113 includes a full range of frequency responses including a bass-frequency response, a treble-frequency response, and a mid-range-frequency response (as shown in FIG. 2). Each of sound panels 302 is configured to generate an audible sound signal that includes a respective range of sound pressure vibrations dependent on the flexural modulus of a material that sound panels 302 are formed of, variations of dimensions of the sound panel, and audio signal 113 received by acoustic exciter 106 coupled to sound panels 302.

Acoustic panel assembly 300 may be formed in a plurality of different shapes, such as, as illustrated, as a rectangular shape 314, which may have portions 316 removed to form, in this example, a cutout for a wheel well having a height 318 and a width 320. A plurality of fasteners 322 may be positioned in acoustic panel assembly 300 at predetermined locations to fix acoustic panel assembly 300 to a structure of the vehicle. Fasteners 322 may also provide an adjustable or selectable compressive force when fixing acoustic panel assembly 300 to the structure. Such variable compressive force may be used to tuning a frequency response of acoustic panel assembly 300.

Figure 5:
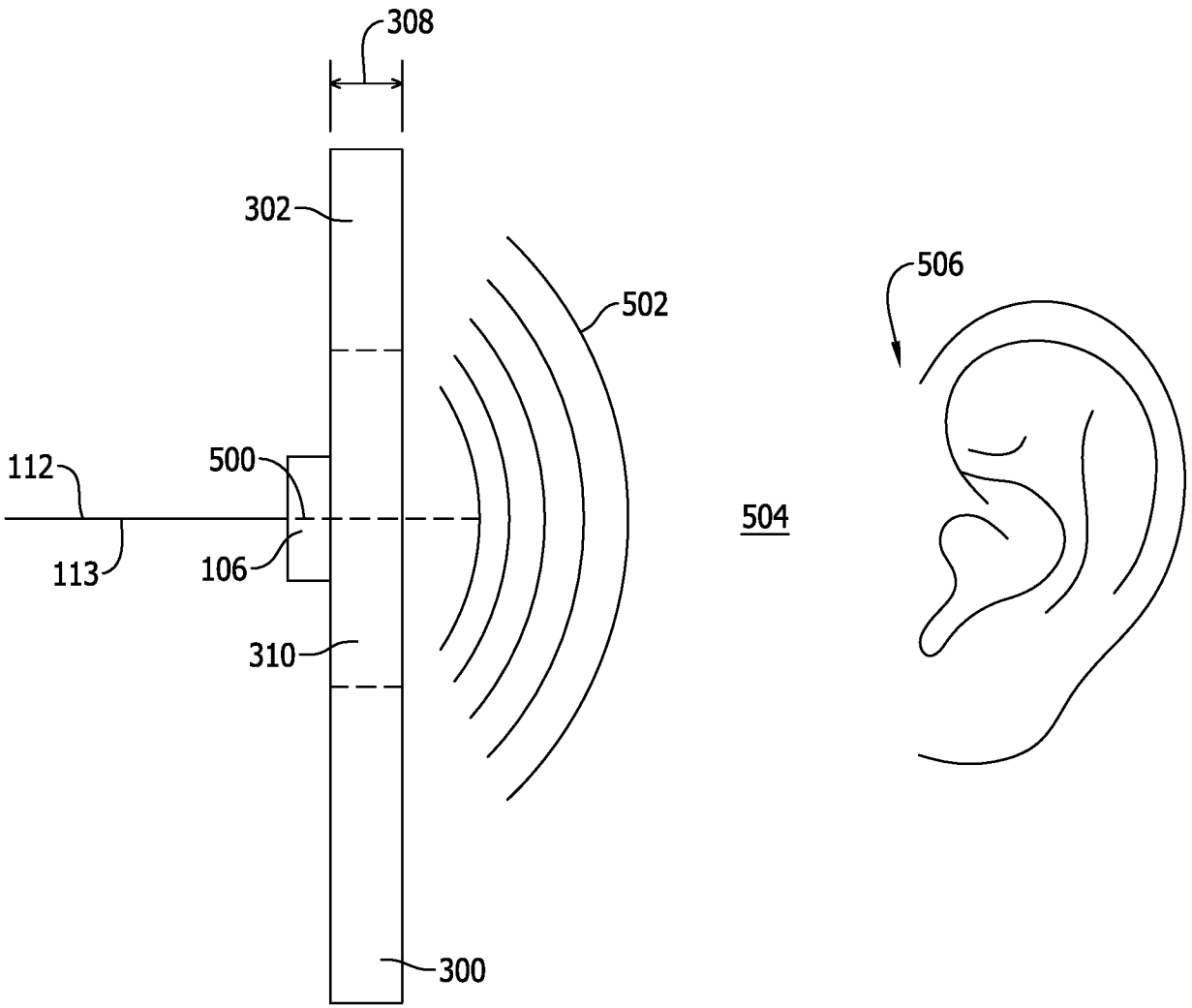

FIG. 5 is a side perspective view of acoustic panel assembly 300 during operation of acoustic exciter 106. Acoustic panel assembly 300 includes acoustic exciter 106 coupled to sound panel 302. In various embodiments, sound panel 302 may be formed as a structural component of the vehicle, a fairing component, and/or a decorative component of the vehicle. During operation, single higher power audio signal 113 is used to excite acoustic exciter 106, which causes acoustic exciter 106 to vibrate at a predetermined rate under the influence of single higher power audio signal 113. The vibrations are generated by acoustic exciter 106 in an axial direction with respect to cylinder axis 500. The vibrations cause a deflection of sound panel 302, which then causes sound pressure variations 502, for example, compressions and rarefactions in the ambient air pressure adjacent to sound panel 302. Sound pressure variations 502 travel through the medium 504 of the air ambient to sound panel 302 and an ear 506 of a listener. In various embodiments, vehicle audio system 100 includes a plurality of acoustic panel assemblies 300. Each acoustic exciter 106 associated with the plurality of acoustic panel assemblies 300 receives the same single higher power audio signal 113. To generate high fidelity sound as perceived by ear 506 of the listener, single higher power audio signal 113 excites all acoustic exciters 106 similarly and it is the frequency response of sound panel 302 that splits the full frequency range single higher power audio signal 113 into bass, mid-range, and treble sound ranges based on the flexural modulus, dimensions, structure, etc. of sound panel 302. In at least some known vehicle audio systems, an equalizer is used to separate various frequency ranges of an audio signal before separate different signals are directed to speakers.

Figure 6:
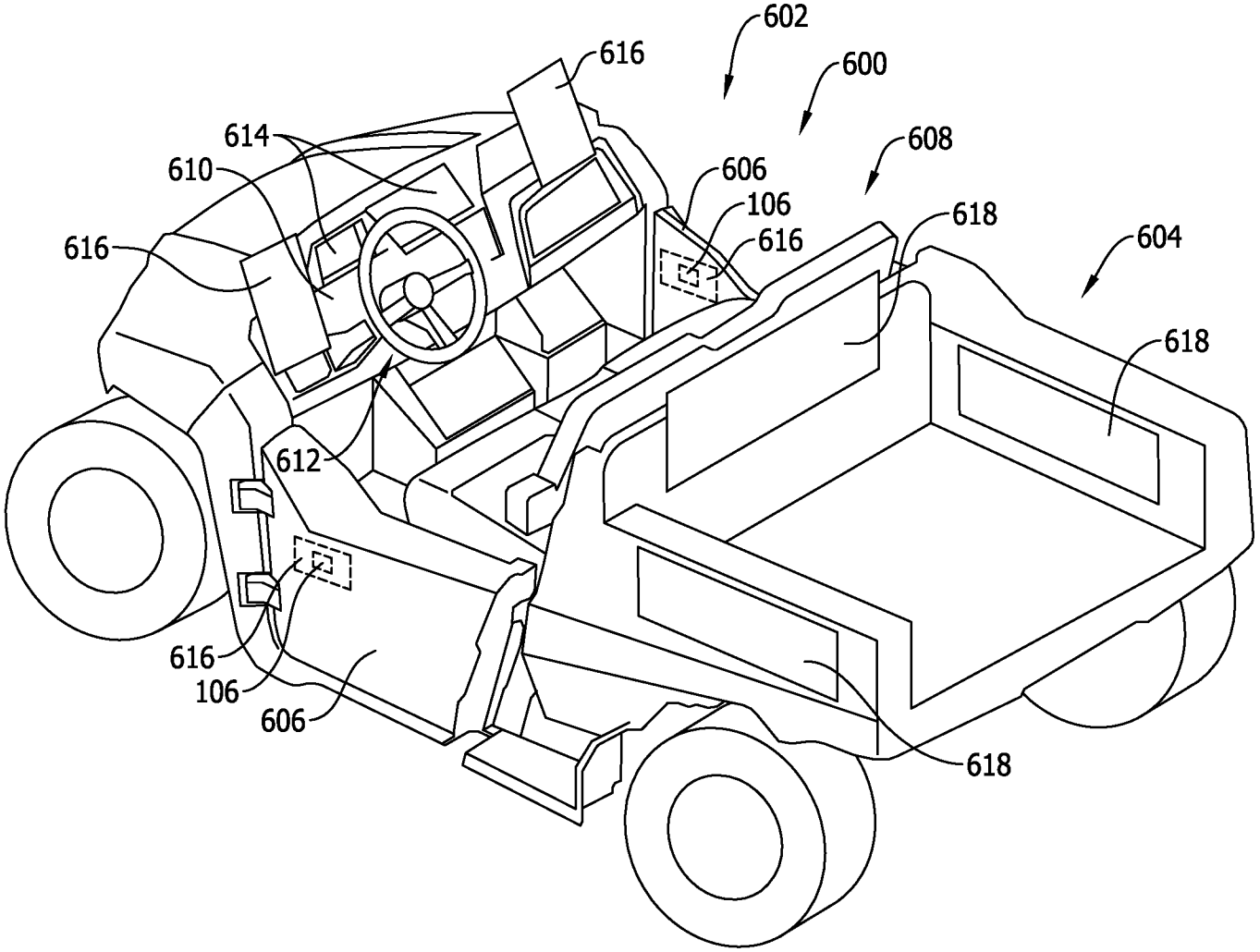

FIG. 6 is a perspective view of a vehicle 600, such as, but not limited to a side-by-side (SxS) off-road vehicle. In the example embodiment, vehicle 600 includes a passenger compartment 602 and a cargo bed 604. Passenger compartment 602 includes doors 606, passenger seats 608, a dashboard, 610, various vehicle controls 612, and indications 614. Doors 606 and dashboard 610 may include areas 616 where sound panel 302 can be positioned and used as part of vehicle audio system 100. Cargo bed 604 may also have areas 618, at which one or more sound panels 302 may also be positioned and used as part of vehicle audio system 100. Selectable factors affecting the frequency response of sound panels 302 include the flexural modulus of the material the sound panel 302 is formed of, the size and shape of the sound panel 302, surface features and structural additions to the sound panel 302, heat treatment or other treatments of sound panel 302. For example, bass and mid-range-frequency responses are better suited for more remote placement of the associated acoustic exciter 106 because low frequency travels farther through media than do high frequencies. Additionally, bass response through objects, such as, walls, room dividers, and seat backs is better than high-frequency response. Accordingly, placement of sound panels 302 tailored to low and mid-range applications is preferentially made to, for example, the sidewalls of cargo bed 604, whereas placement of sound panels 302 tailored to high-frequency applications is preferentially made to, for example, passenger compartment 602.

Figure 7:
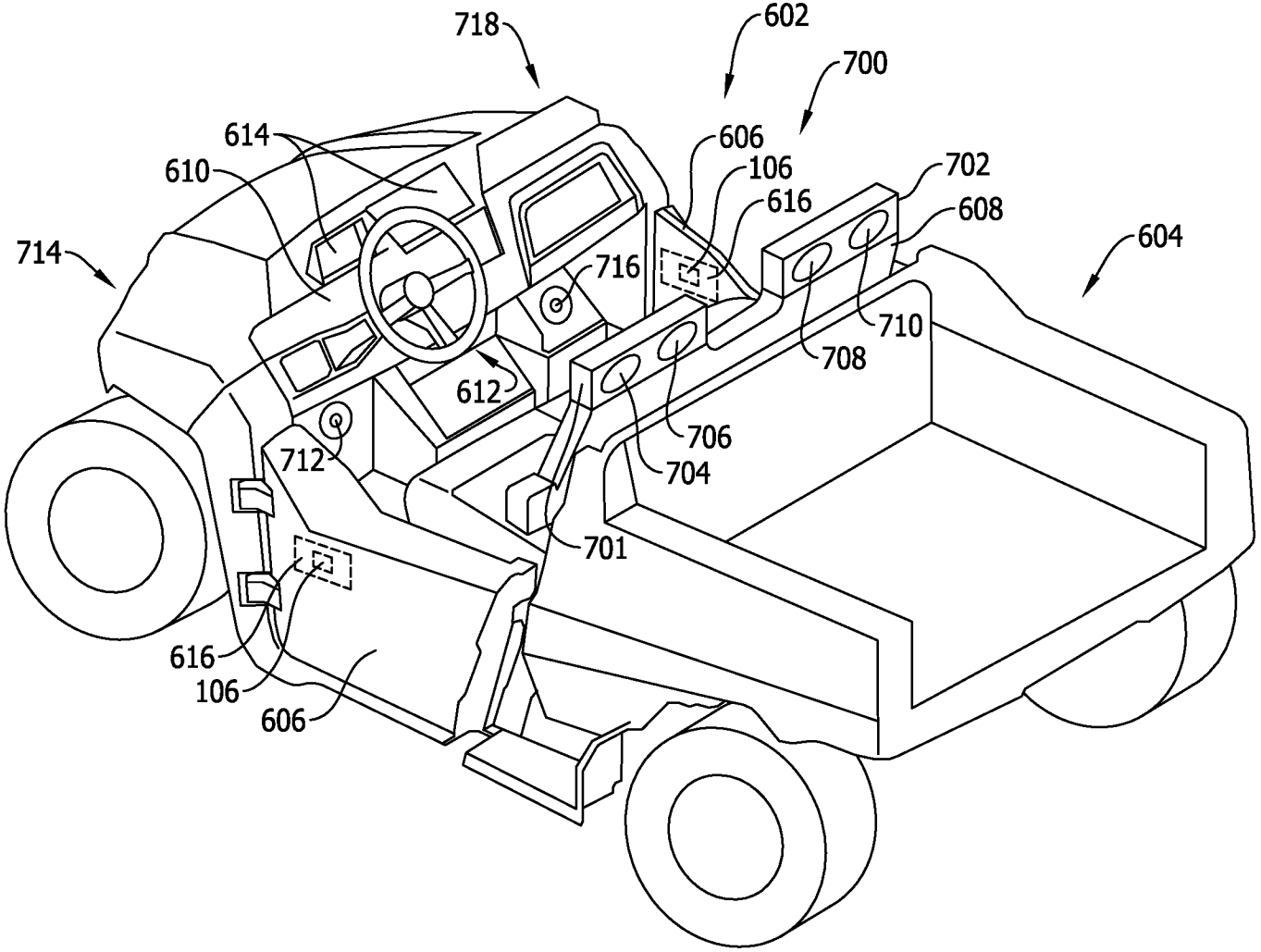

FIG. 7 is a perspective view of a vehicle 700 in accordance with another example embodiment of the present disclosure. In this embodiment, vehicle 600 includes passenger seats 608 that each includes a driver headrest 701 and a passenger headrest 702. Each of driver headrest 701 and passenger headrest 702 include one or more acoustic exciters 106. In the example embodiment, driver headrest 701 includes a left-channel acoustic exciter 704 and a right-channel acoustic exciter 706. Passenger headrest 702 includes a left-channel acoustic exciter 708 and a right-channel acoustic exciter 710. Vehicle 700 also includes a plurality of cone speakers, for example, a left-channel speaker 712 located on or under dashboard 610 on a driver's side 714 and a right-channel speaker 716 located on or under dashboard 610 on a passenger's side 718 of vehicle 700. Also in this embodiment, equalizer 118 (shown in FIG. 1) may be used to generate or amplify the right and left channel signals for use in speakers 712 and 716. Amplifier 140 may be used to generate or amplify the signals for use in acoustic exciters 704, 706, 708, and 710.

Figure 8:
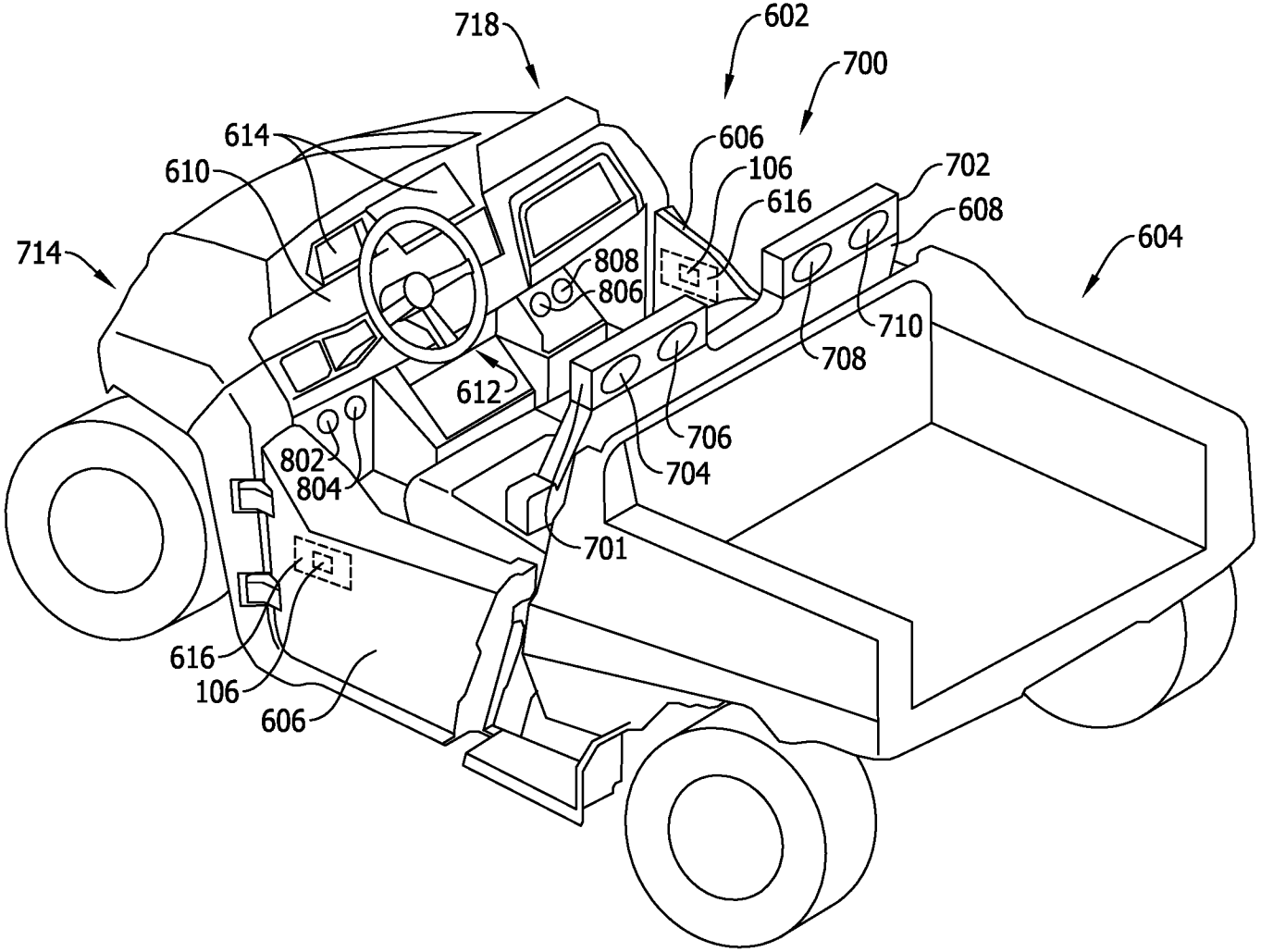

FIG. 8 is a perspective view of vehicle 700 (shown in FIG. 7) in accordance with another example embodiment of the present disclosure. In this embodiment, vehicle 700 includes passenger seats 608 that each includes driver headrest 701 and passenger headrest 702. Each of driver headrest 701 and passenger headrest 702 include one or more acoustic exciters 106. In the example embodiment, driver headrest 701 includes left-channel acoustic exciter 704 and right-channel acoustic exciter 706. Passenger headrest 702 includes left-channel acoustic exciter 708 and right-channel acoustic exciter 710. Vehicle 700 also includes a plurality of other acoustic exciters 106, for example, a left-channel acoustic exciter 802 and right-channel acoustic exciter 804 located on or under dashboard 610 on driver's side 714 of vehicle 700. Vehicle 700 also includes a left-channel acoustic exciter 806 and right-channel acoustic exciter 808 located on or under dashboard 610 on passenger's side 718 of vehicle 700. Also in this embodiment, amplifier 140 (shown in FIG. 1) may be used to generate or amplify the right and left channel signals for use in acoustic exciters 704, 706, 708, 710, 802, 804, 806, and 808.

Figure 9:
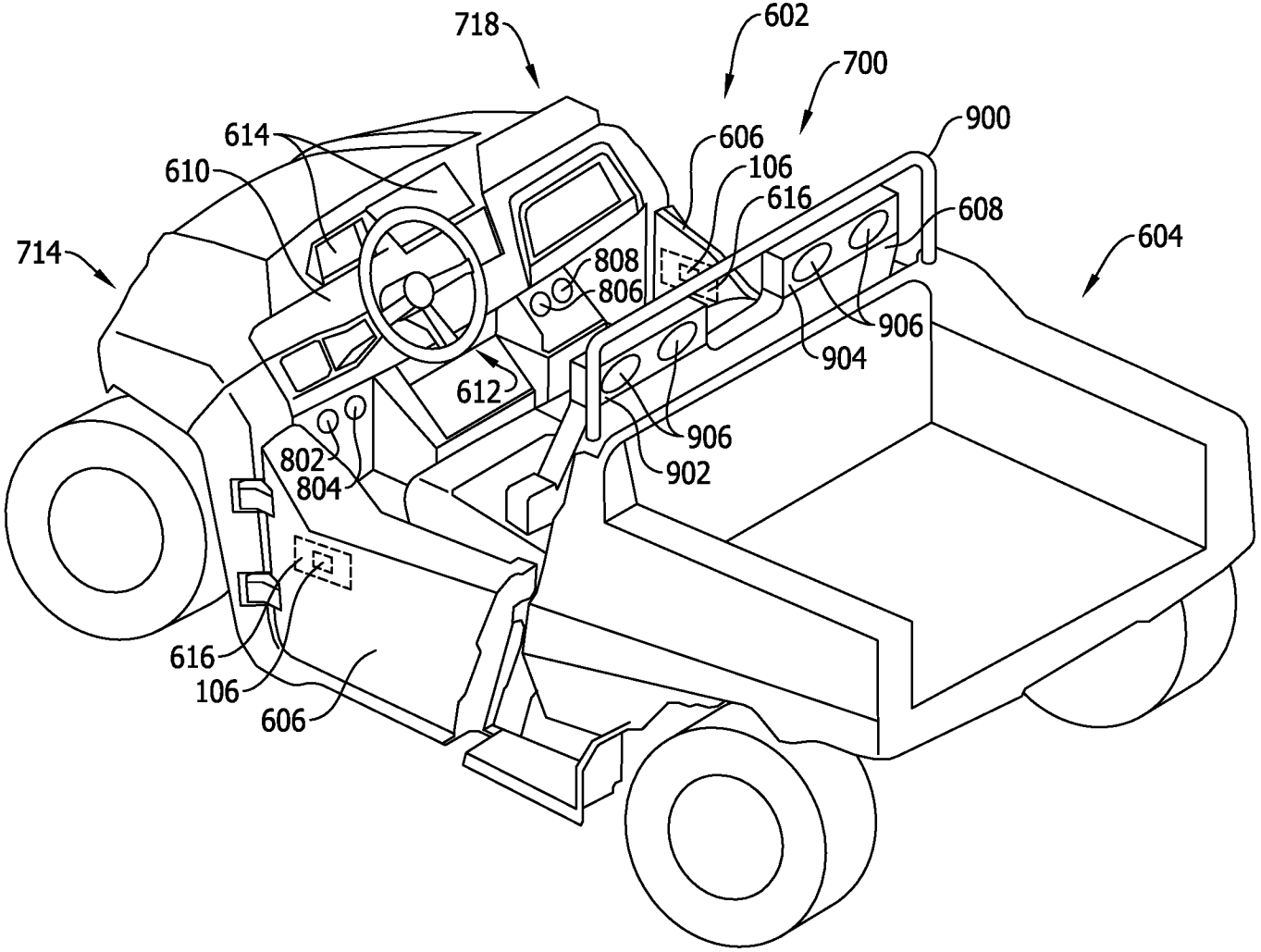

FIG. 9 is a perspective view of vehicle 700 in accordance with another example embodiment of the present disclosure. In the example embodiment, vehicle 700 includes a rollover protection system or rollover protection structure (ROPS) 900, which is a system or structure, intended to protect equipment operators and motorists from injuries caused by vehicle overturns or rollovers. In this embodiment, ROPS 900 is used to facilitate mounting a first sound panel 902 behind passenger seat 608 on driver's side 714 and a second sound panel 904 behind passenger seat 608 on passenger's side 718. Each of sound panels 902 and 904 include one or more acoustic exciters 906 that function similarly to acoustic exciters 704, 706, 708, 710 (shown in FIGS. 7 and 8).

Figure 10:
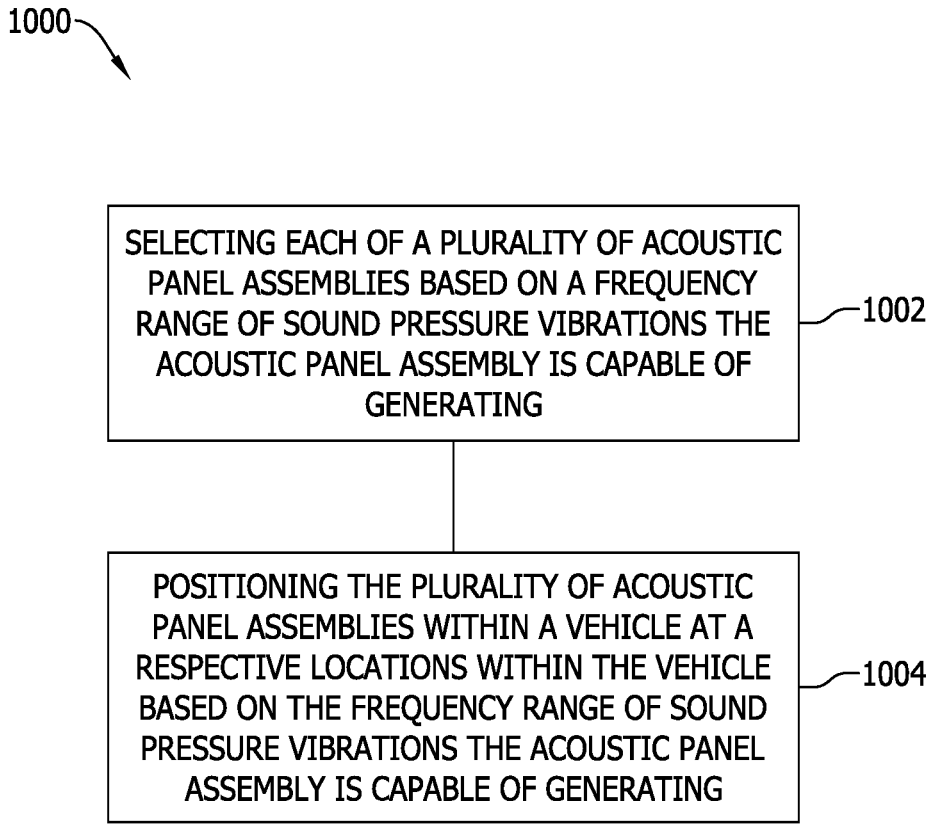

FIG. 10 is a flowchart of a method 1000 of generating sound having a plurality of frequency responses in accordance with an example embodiment of the present disclosure. In the example embodiment, method 1000 includes selecting 1002 each of a plurality of acoustic panel assemblies based on a frequency range of sound pressure vibrations the acoustic panel assembly is capable of generating and positioning 1004 the plurality of acoustic panel assemblies within a vehicle at a respective locations within the vehicle based on the frequency range of sound pressure vibrations the acoustic panel assembly is capable of generating.

Embodiments of a vehicle sound system, a method of generating sound having a plurality of frequency responses, and a speakerless vehicle sound system are described herein. The vehicle sound system includes a plurality of acoustic panel assemblies positionable within a vehicle. Each acoustic panel assembly includes a first sound panel formed of a material having predetermined physical dimensions and a first flexural modulus. Each acoustic panel assembly also includes one or more acoustic exciters coupled to each of the first sound panels. Each acoustic exciter is configured to receive a first audio signal that includes a first frequency range. Each of the first sound panels is configured to generate a sound signal that has a respective range of sound pressure vibrations dependent at least partially on the first flexural modulus, the predetermined physical dimensions of the first sound panel, and the first audio signal received by the one or more acoustic exciters.

A first acoustic panel assembly of the plurality of acoustic panel assemblies is formed to generate a first sound signal in a first range of sound pressure vibrations from the first audio signal. Based on the generated first sound signal, the first acoustic panel assembly is positioned in a first location in the vehicle. The first location provides a site that is complementary to the sound performance desired and the structural and aesthetic requirements of the vehicle panels. For example, some vehicle panels may provide only cover for equipment or structure that is desired to be covered for aesthetic reasons. Other panels may have a structural component included in their function. In either case, these panels may be formed or modified to accommodate an acoustic exciter and then include the additional function of being able to generate sound from an audio signal channeled from a source to the acoustic exciter. Importantly, the sound generated for the vehicle sound system is generated without speakers and the sound is equalized by the flexural modulus of the sound panel, the predetermined physical dimensions of the sound panel, and the audio signal received by the one or more acoustic exciters.

The vehicle sound system includes a second acoustic panel assembly of the plurality of acoustic panel assemblies formed to generate a second sound signal in a second range of sound pressure vibrations from the first audio signal and positioned in a second location in the vehicle, the second range of sound pressure vibrations being different then the first range of sound pressure vibrations. The first and second acoustic panel assemblies receive the same audio signal from a source through an amplifier. If an equalizer were used, as in, for example, prior art systems, a high-frequency component of the audio signal would be channeled to a tweeter or speaker capable of reproducing the higher frequencies of the audio signal. Similarly, the equalizer would channel mid-range frequencies preferentially to a mid-range driver or speaker and a low-frequency portion of the audio signal would be channeled to a woofer or speaker capable of reproducing the low-frequency portion of the audio signal. However, in the vehicle sound system described, speakers are not used and an equalizer is not used. Rather, the plurality of acoustic panel assemblies act as a speaker that has a selectable frequency response that obviates the need for an equalizer.

In some embodiments, at least some of the plurality of acoustic panel assemblies include a second sound panel having a second material having a second flexural modulus value. The flexural modulus may be tailored to a specific location the second sound panel will be placed and may take into account whether the second sound panel is a structural vehicle panel or just an aesthetic panel. The second sound panel configured to generate a sound signal comprising a second range of sound pressure vibrations using a second set of dimensions and the first audio signal. The second range of sound pressure vibrations being different than the first range of sound pressure vibrations because of the equalizer effect of the differences in the flexural modulus value and dimensions between the first sound panel and the second sound panel.

The vehicle sound system may also include an audio amplifier including a first channel operatively coupled to the one or more acoustic exciters. The first channel is configured to provide the first audio signal to the one or more acoustic exciters. In some embodiments, the audio amplifier includes a second channel configured to provide a second audio signal having a second frequency range. At least a first portion of the second frequency range is less than at least a first portion the first frequency range. The first audio signal may include a plurality of sub-ranges of frequencies including a low-frequency sub-range, a mid-frequency sub-range, and a high-frequency sub-range.

A first acoustic panel assembly of the plurality of acoustic panel assemblies is configured to generate sound pressure vibrations in the high-frequency sub-range based on the flexural modulus of the first acoustic panel assembly, a first set of dimensions of the first acoustic panel assembly including at least a thickness, and the first audio signal. The thickness optionally includes a gradient along at least one of a length and a width of a sound panel of the first acoustic panel assembly, the flexural modulus in any area of the sound panel being at least partially dependent on the thickness of the sound panel in that area. In various embodiments, the vehicle includes a passenger compartment and a cargo bed and wherein the first acoustic panel assembly of the plurality of acoustic panel assemblies is positioned within the passenger compartment of the vehicle. A second acoustic panel assembly of the plurality of acoustic panel assemblies is configured to generate sound pressure vibrations in at least one of the low-frequency sub-range, and the mid-frequency sub-range and is positioned within the cargo bed of the vehicle.

The method of generating sound having a plurality of frequency responses includes positioning a plurality of acoustic panel assemblies within a vehicle at a location within the vehicle that is selected based on a frequency range of sound pressure vibrations the acoustic panel assembly is capable of generating. Optionally, the method includes receiving, by a plurality of acoustic exciters, a single electrical audio signal including a plurality of frequency ranges including at least a low-frequency range signal component, a mid-frequency range signal component, and a high-frequency range signal component. The plurality of acoustic exciters are coupled to a plurality of sound panels. Each sound panel is formed of a material having a predetermined flexural modulus. The predetermined flexural modulus defines the ability of the acoustic exciters to cause vibrations in the respective sound panel. The greater the flexural modulus value, the stiffer the sound panel will be, tending to make the sound panel respond to higher frequency components of the single electrical audio signal to generate higher frequency sound pressure vibrations. To effectively use the different capabilities of the sound panels formed as described above, the method may include positioning a bass-range acoustic panel assembly capable of generating a low-frequency range of sound pressure vibrations based on the predetermined flexural modulus of the bass-range acoustic panel assembly in a cargo bed of the vehicle, positioning a high-frequency range acoustic panel assembly capable of generating a high-frequency range of sound pressure vibrations based on the predetermined flexural modulus of the treble-range acoustic panel assembly in a passenger compartment of the vehicle. The method may also optionally include positioning a mid-range acoustic panel assembly capable of generating a mid-frequency range of sound pressure vibrations based on the predetermined flexural modulus of the mid-range acoustic panel assembly in at least one of a passenger compartment of the vehicle and a cargo bed of the vehicle.

A speakerless vehicle sound system comprising a plurality of acoustic panel assemblies positioned within a vehicle according to a frequency response of each of the plurality of acoustic panel assemblies to a single electrical audio signal, each of the plurality of acoustic panel assemblies comprising an acoustic exciter configured to receive the single electrical audio signal and coupled to a sound panel that forms a part of a structural or aesthetic component of the vehicle, the sound panel configured to generate a range of sound pressure vibrations dependent on a flexural modulus of a material the sound panel is formed of, a set of dimensions of the sound panel, and the single electrical audio signal. A first acoustic panel assembly of the plurality of acoustic panel assemblies is responsive to a relatively high frequency component of the single electrical audio signal to generate a relatively high audible frequency range of sound pressure vibrations dependent on the flexural modulus of the material the sound panel is formed of, a set of dimensions of the sound panel, and the single electrical audio signal. A second acoustic panel assembly of the plurality of acoustic panel assemblies is responsive to a relatively low frequency component of the single electrical audio signal to generate a relatively low audible frequency range of sound pressure vibrations dependent on the flexural modulus of the material the sound panel is formed of, a set of dimensions of the sound panel, and the single electrical audio signal. A third acoustic panel assembly of the plurality of acoustic panel assemblies is responsive to a relatively mid-range frequency component of the single electrical audio signal to generate a relatively mid-range audible frequency range of sound pressure vibrations dependent on the flexural modulus of the material the sound panel is formed of, a set of dimensions of the sound panel, and the single electrical audio signal.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A vehicle sound system, the vehicle sound system comprising:

a plurality of acoustic panel assemblies positionable within a vehicle, each acoustic panel assembly comprising:

a first sound panel formed of a material having predetermined physical dimensions and a first flexural modulus; and one or more acoustic exciters coupled to each of the first sound panels, each acoustic exciter configured to receive a first audio signal comprising a first frequency range, each of the first sound panels configured to generate a sound signal comprising a respective range of sound pressure vibrations dependent on the first flexural modulus, the predetermined physical dimensions of the first sound panel, and the first audio signal received by the one or more acoustic exciters, a first acoustic panel assembly of the plurality of acoustic panel assemblies formed to generate a first sound signal in a first range of sound pressure vibrations from the first audio signal and positioned in a first location in the vehicle based on the first sound signal in the first range of sound pressure vibrations, and a second acoustic panel assembly of the plurality of acoustic panel assemblies formed to generate a second sound signal in a second range of sound pressure vibrations from the first audio signal and positioned in a second location in the vehicle based on the second sound signal in the second range of sound pressure vibrations, the second range of sound pressure vibrations being different than the first range of sound pressure vibrations and the second location being different from the first location.

2. The vehicle sound system of claim 1, wherein at least some of the plurality of acoustic panel assemblies comprise a second sound panel comprising a second material having a second flexural modulus value, the second sound panel configured to generate a sound signal comprising a third range of sound pressure vibrations using a second set of dimensions and the first audio signal, the third range of sound pressure vibrations different than the first range of sound pressure vibrations.

3. The vehicle sound system of claim 1, further comprising an audio amplifier comprising a first channel operatively coupled to the one or more acoustic exciters, the first channel configured to provide the first audio signal to the one or more acoustic exciters.

4. The vehicle sound system of claim 3, further comprising a second channel configured to provide a second audio signal having a second frequency range, at least a first portion of the second frequency range being less than at least a first portion the first frequency range.

5. The vehicle sound system of claim 3, further comprising a headrest of a passenger seat, said headrest including one or more acoustic exciters embedded within, wherein at least some of the one or more acoustic exciters is communicatively coupled to said audio amplifier.

6. The vehicle sound system of claim 1, wherein the first audio signal comprises a plurality of sub-ranges of frequencies including a low-frequency sub-range, a mid-frequency sub-range, and a high-frequency sub-range.

7. The vehicle sound system of claim 6, wherein the first acoustic panel assembly of the plurality of acoustic panel assemblies is configured to generate sound pressure vibrations in the high-frequency sub-range based on the flexural modulus of the first acoustic panel assembly, a first set of dimensions of the first acoustic panel assembly including at least a thickness, and the first audio signal.

8. The vehicle sound system of claim 7, wherein the thickness comprises a gradient along at least one of a length and a width of a sound panel of the first acoustic panel assembly, the flexural modulus in any area of the sound panel being at least partially dependent on the thickness of the sound panel in that area.

9. The vehicle sound system of claim 7, wherein the vehicle includes a passenger compartment and a cargo bed and wherein the first acoustic panel assembly of the plurality of acoustic panel assemblies is positioned within the passenger compartment of the vehicle.

10. The vehicle sound system of claim 6, wherein the second acoustic panel assembly of the plurality of acoustic panel assemblies is configured to generate sound pressure vibrations in at least one of the low-frequency sub-range, and the mid-frequency sub-range.

11. The vehicle sound system of claim 10, wherein the vehicle includes a passenger compartment and a cargo bed and wherein the second acoustic panel assembly of the plurality of acoustic panel assemblies is positioned within the cargo bed of the vehicle.

12. A speakerless vehicle sound system comprising a plurality of acoustic panel assemblies positioned within a vehicle, each of the acoustic panel assemblies generating a respective and different frequency response to a single electrical audio signal, each of the plurality of acoustic panel assemblies comprising an acoustic exciter configured to receive the single electrical audio signal and coupled to a sound panel that forms a part of a structural or aesthetic component of the vehicle, the sound panel configured to generate a range of sound pressure vibrations dependent on a flexural modulus of a material the sound panel is formed of, a set of dimensions of the sound panel, and the single electrical audio signal, wherein each of the acoustic panel assemblies is positioned at a respective and different location within the vehicle based on the respective frequency response thereof.

13. The speakerless vehicle sound system of claim 12, wherein a first acoustic panel assembly of the plurality of acoustic panel assemblies is responsive to a relatively high frequency component of the single electrical audio signal to generate a relatively high audible frequency range of sound pressure vibrations dependent on the flexural modulus of the material the sound panel is formed of, a set of dimensions of the sound panel, and the single electrical audio signal.

14. The speakerless vehicle sound system of claim 12, wherein a second acoustic panel assembly of the plurality of acoustic panel assemblies is responsive to a relatively low frequency component of the single electrical audio signal to generate a relatively low audible frequency range of sound pressure vibrations dependent on the flexural modulus of the material the sound panel is formed of, a set of dimensions of the sound panel, and the single electrical audio signal.

15. The speakerless vehicle sound system of claim 12, wherein a third acoustic panel assembly of the plurality of acoustic panel assemblies is responsive to a relatively mid-range frequency component of the single electrical audio signal to generate a relatively mid-range audible frequency range of sound pressure vibrations dependent on the flexural modulus of the material the sound panel is formed of, a set of dimensions of the sound panel, and the single electrical audio signal.

* * * * *